US011225345B2

(12) United States Patent
Roidl et al.

(10) Patent No.: US 11,225,345 B2
(45) Date of Patent: Jan. 18, 2022

(54) METHOD AND APPARATUS FOR PRODUCING BEVERAGE CONTAINERS WITH RECOOLING AND GAS FEED

(71) Applicant: KRONES AG, Neutraubling (DE)

(72) Inventors: Wolfgang Roidl, Deuerling (DE); Jochen Hirdina, Regensburg (DE)

(73) Assignee: KRONES AG

( * ) Notice: Subject to any disclaimer, the term of this patent is extended or adjusted under 35 U.S.C. 154(b) by 341 days.

(21) Appl. No.: 16/340,353

(22) PCT Filed: Oct. 19, 2017

(86) PCT No.: PCT/EP2017/076706

§ 371 (c)(1),
(2) Date: Apr. 8, 2019

(87) PCT Pub. No.: WO2018/073341

PCT Pub. Date: Apr. 26, 2018

(65) Prior Publication Data

US 2019/0248524 A1 Aug. 15, 2019

(30) Foreign Application Priority Data

Oct. 19, 2016 (DE) ..... 10 2016 119 890.0

(51) Int. Cl.

| | |
|---|---|
| ***B65B 31/08*** | (2006.01) |
| ***B65B 31/00*** | (2006.01) |
| ***B67C 3/22*** | (2006.01) |

(52) U.S. Cl.

CPC ..... *B65B 31/006* (2013.01); *B67C 3/22* (2013.01); *B67C 2003/226* (2013.01)

(58) Field of Classification Search

CPC ... B67C 3/22; B67C 2003/226; B65B 31/006; B65B 31/08

See application file for complete search history.

(56) References Cited

U.S. PATENT DOCUMENTS 5,641,004 A * 6/1997 Py ..... B65B 3/003 141/3
6,474,368 B2 * 11/2002 Clusserath ..... B67C 3/12 141/129

(Continued)

FOREIGN PATENT DOCUMENTS

CN 10219099 A 9/2011 ..... B65B 55/04
DE 102010012211 9/2011 ..... B65B 55/04

(Continued)

OTHER PUBLICATIONS

German Search Report (w/machine translation) issued in application No. 10 2016 119 890.0, dated Apr. 21, 2017 (13 pgs).

(Continued)

*Primary Examiner* — Andrew M Tecco
(74) *Attorney, Agent, or Firm* — Hayes Soloway P.C.

(57) ABSTRACT

Disclosed is a method for producing liquid containers by:

producing a plastic container by a blow moulding process;

filling the plastic container with a flowable medium, such as a liquid; and at least partially closing the container, which is filled with the liquid, with a container closure. After the at least partial closing of the container, a gaseous medium is fed to the interior of the container via at least one opening introduced into at least one portion of a wall of the plastic container or a circumferential wall of the container closure or via an intermediate space which exists between a mouth and the container closure.

11 Claims, 3 Drawing Sheets

(56) References Cited

U.S. PATENT DOCUMENTS

| | | | | |
|---|---|---|---|---|
| 6,604,561 | B2 * | 8/2003 | Py | A61J 1/18 141/329 |
| 8,950,611 | B2 * | 2/2015 | Derrien | B65D 79/005 215/373 |
| 9,254,617 | B2 * | 2/2016 | Maki | B29C 49/786 |
| 9,428,292 | B2 * | 8/2016 | Taber | B65B 31/06 |
| 9,643,746 | B1 * | 5/2017 | Lunn | B65B 31/08 |
| 10,703,617 | B2 * | 7/2020 | Melrose | B67C 3/22 |
| 2006/0096661 | A1 | 5/2006 | Chaude | 141/329 |
| 2010/0225030 | A1 * | 9/2010 | Hirdina | B67C 3/225 264/524 |
| 2011/0225932 | A1 | 9/2011 | Hirdina | 53/426 |
| 2012/0311966 | A1 * | 12/2012 | Melrose | B67B 3/00 53/403 |
| 2013/0106027 | A1 * | 5/2013 | Maki | B29C 49/786 264/524 |
| 2013/0239522 | A1 * | 9/2013 | Melrose | B65D 1/0261 53/467 |
| 2015/0076105 | A1 * | 3/2015 | Sato | B29C 49/78 215/381 |
| 2015/0121807 | A1 * | 5/2015 | Taber | B65B 31/08 53/431 |
| 2018/0127126 | A1 * | 5/2018 | Delage | B65B 31/006 |
| 2019/0283911 | A1 * | 9/2019 | Delage | B65B 31/046 |

FOREIGN PATENT DOCUMENTS

| | | | |
|---|---|---|---|
| DE | 102014102971 | 9/2015 | B65D 51/28 |
| GB | 1561143 | 2/1980 | B65B 31/04 |
| WO | WO2011062512 | 5/2011 | B65B 31/04 |
| WO | WO2012067524 | 5/2012 | B67C 3/06 |

OTHER PUBLICATIONS

International Search Report and Written Opinion (w/translation) issued in application No. PCT/EP2017/076706, dated Jan. 15, 2018 (21 pgs).

Chinese Office Action (w/translation) issued in application No. 201780064809.2, dated Aug. 14, 2020 (22 pgs).

* cited by examiner

METHOD AND APPARATUS FOR PRODUCING BEVERAGE CONTAINERS WITH RECOOLING AND GAS FEED

BACKGROUND OF THE INVENTION

The present invention relates to a method and apparatus for producing beverage containers as well as an apparatus for producing a pressure equalisation in containers. Such methods and apparatus have been known for a long time from the prior art. In this case it is also known in particular that specific beverages, such as for example iced tea, are bottled while hot. However, such hot filling methods are associated with specific difficulties. Thus, for example in the hot filling of beverages into plastic bottles it can occur that these bottles contract after the filling due to the falling internal pressure.

To some extent in the prior art it is attempted to counteract this situation with specific container designs, for instance with designs which are suitable for absorbing fluctuating pressures.

Furthermore, it is known for containers, in particular PET containers, to be formed at least in part hydraulically. If hot medium is used for the forming, it is disadvantageous that the container must be a so-called "hot fill container", that is to say a container which on the one hand withstands the temperature of the forming medium (PET tends to deformation under the effect of temperature, so-called memory effect) and on the other hand withstands the negative pressure produced in the container by the cooling of the medium. In the prior art so-called panel bottles are used for this purpose, wherein the panels have precisely the property of deforming in a "defined" manner during cooling of the product in the bottle and so do not impair the overall appearance of the container by undefined changes or deformations.

Furthermore, it is known to use other types of container or methods in order to implement hot fill applications. Thus, for example the "nitro hot fill" method is known, wherein, just before the closing, liquid nitrogen is introduced into the head space of the container. This positive pressure in the container can then be reduced during cooling, so that then a "normal pressure" is available.

A disadvantageous in this case is the need to use a pressure-resistant (container) base. The design freedom of the bottle manufacturers is severely restricted in the application of this method.

Furthermore, special solutions are known, such as the use of deforming bottle bases, which are changed in their position (for example pushed inwards) after or during the cooling of the product, in order thus to influence the volume in the container.

A disadvantage of this method is the difficulty in determining the final filling level as well as the complicated handling of the bottles, since the bases are shaped very precisely and must also be finished carefully with a corresponding discrete machine.

OBJECT OF THE INVENTION

Therefore, the object of the present invention is to provide a method and an apparatus which in particular simplify a hot filling process. In this case in particular it should be borne in mind that the beverages are first of all bottled in a heated state and subsequently the containers are closed and are subsequently cooled.

SUMMARY OF THE INVENTION

In a method according to the invention for producing liquid containers and in particular beverage containers, in a first method step a plastic container is produced by a blow moulding process. Then the plastic container is filled with a flowable medium, and in particular with a liquid. In a further method step at least partial closing of the container, which is filled with the liquid, is carried out with a container closure. Liquids are also understood to be liquids with a specific gas content, for instance liquids which steam considerably because of their high temperature.

According to the invention, after the partial closing of the container, a gaseous medium is fed to the interior of the container via at least one opening provided (and in particular introduced) into at least one portion of the plastic container or a circumferential wall of the container closure. In addition, it is also possible that the opening is formed by a gap between the container closure and the container, for instance if the container is not yet completely closed. However, the opening is a hole in the wall of the container or in the circumferential wall of the container closure.

It is therefore proposed that in particular after the partial closing and for example during or after a recooling process a gaseous medium is fed to the container, in order thus to be able to counteract a falling internal pressure inside the container.

In a preferred method the plastic container is produced by a blow moulding process and in particular a stretch blow moulding process. In this case it is possible that first of all the plastic parisons are heated and the plastic parisons are introduced in the heated state into a blow mould. Inside the blow mould the plastic parisons are expanded to form the plastic containers and in particular plastic bottles. Advantageously in this case such blow moulds have both side parts and also a base part. These side parts and the base part together form a hollow space within which the plastic parison is expanded to produce a plastic bottle by application of a medium and in particular compressed air.

Likewise the said side parts and/or the base part of the blow mould are advantageously heated. Advantageously in this case the blow moulding process takes place with a predetermined temperature of the blow moulds. Thus, for example the base part of the blow mould can be heated to a temperature of at least 50° C., preferably at least 60° C., preferably at least 70° C. and preferably at least 80° C. In this case this heating of the base part can be achieved by means of water flowing through a region of the base part.

The said side parts of the blow mould are also advantageously heated. Advantageously in this case a heating to at least 80° C., preferably at least 90° C., preferably at least 100° C., preferably at least 120° C. and particularly preferably at least 130° C. takes place. In this case this heating can be achieved for example by a through flow of a flowable medium, such as for example by a through flow of oil.

The said side parts of the blow mould are advantageously also arranged on side part carriers. Particularly preferably these side part carriers are also heated to a specific temperature, for example to a temperature of more than 30° C., preferably more than 40° C., preferably more than 50° C.

As mentioned above, the said opening is located in a wall of the plastic container or a circumferential wall of the container closure. However, it would also be possible that the gaseous medium is fed via an opening or a gap which exists between the container or the mouth thereof on the one hand and the container closure on the other hand. For this purpose it would be possible that initially the container closure is not yet completely screwed onto the container, but first of all the gaseous medium is fed via the said gap. The container closure is preferably a screw closure which is in particular screwed onto an external thread of the container.

In this variant the pressure is already built up in the container during the closing process. In other variants, however, the product is not yet cooled during the closing process, so that the pressure which is then to be built up in the bottle is significantly above atmospheric pressure, in order then to find the required pressure conditions during recooling.

In a further advantageous method the closure is opened easily after the recooling (under defined environmental conditions, for example in a chamber), so that a communication connection between the environment and the interior of the container is produced. This can take place for example by slightly unscrewing of the closure. Thus, a reduction of the negative pressure can take place. In this case this opening process can take place so that a tamper-evident strip does not tear off and the closure can be closed again normally.

In a further preferred method the gas is a sterile and/or inert gas. The gas is particularly preferably nitrogen ($N_2$).

In a further preferred method the containers are transported during the production thereof and/or during the bottling and/or during the feeding of the gaseous medium. Advantageously the containers are transported at least section by section along an arcuate path.

In a further preferred method the containers are transported at least section by section through a clean room. This means that the method steps described here, in particular also the step of feeding the gaseous medium, takes place under clean room conditions or under sterile conditions. In this case this clean room is preferably sealed or separated off by means of at least one wall relative to an (unsterile) environment.

In a further preferred method the containers are sterilised. Thus it is possible that the containers are sterilised directly after production thereof. However it would also be possible that the plastic parisons are already sterilised before the transforming process to produce plastic bottles. Thus it is also possible that the actual transforming process for transforming plastic parisons into plastic bottles already takes place under sterile conditions. In this case this sterilising can take place for example by means of a sterilising medium such as for instance hydrogen peroxide or peracetic acid, but also by means of radiation, for example electron radiation. However, it is pointed out that the sterilisation is an optional method step.

This applies in particular in the case of those products in which the sterility is achieved by means of the heating of the liquid to be introduced.

In a further preferred method the said opening is introduced into a wall of the container or a section of the wall of the container (or in a section of the circumferential wall of the container closure). This opening is preferably introduced after the blow moulding process. This introduction of the opening takes place in particular after closing of the container with a container closure and in particular after the filling of the container. As mentioned above, however, the opening can also be already present in the closure, for example the closure can have been produced already with such an opening.

Advantageously the said container wall is pierced, for example with a needle-like body. Preferably this needle-like body or this needle can have a diameter which is less than 4 mm, preferably less than 3 mm, and particularly preferably less than 2 mm. In this case it is also possible that the needle itself is heated in order to pierce the container wall. In this way the material of the container can also be melted locally during the piercing.

Thus, it is possible that a temperature of the needle (at least in the portion which contacts the wall of the container) is greater than 60° C., preferably greater than 70° C., preferably greater than 80° C. and particularly preferably greater than 90° C.

In a further preferred method the container is filled with a heated liquid. This liquid to be bottled can have a temperature of more than 40° C., preferably more than 50° C., preferably more than 60° C., and particularly preferably more than 70° C. The liquid preferably has a temperature of less than 110° C., preferably less than 100° C. and particularly preferably less than 95° C. Particularly preferably a temperature of the liquid is between 82° C. and 92° C. This is preferably also the bottling temperature.

At least partial closure of the container is preferably understood to mean that for instance a rotary closure is screwed to a certain extent onto a thread of the container, but is not yet tightly closed. Advantageously, however, the container closure is already screwed firmly and thus in a sealing manner on the mouth of the container, which thus preferably corresponds to a complete sealing of the container with the container closure. The heated liquid is advantageously a beverage.

In a further preferred method the container which is filled with the liquid and preferably also closed is cooled. A recooling of the container to a temperature which is below the bottling temperature preferably takes place. A recooling preferably takes place to below a temperature of 70° C., preferably to below a temperature of 60° C., particularly preferably to below a temperature of 50° C. and particularly preferably to below a temperature of 45° C. The feeding of the gaseous medium takes place particularly preferably during or after the said cooling. In this way pressure changes which occur can be equalised again. In this variant of the method it is possible in particular also to use containers without bases which are resistant to positive pressure.

In this case this cooling of the containers can be carried out at different times or in different steps of the entire method. Thus, it is possible, that the cooling takes place before the feeding of the gaseous medium. In a further preferred method the container is first of all filled with a heated liquid, then closed, then recooled and finally the gas feeding takes place.

It would also be conceivable that first of all a filling with a heated liquid, then the feeding of the gaseous medium is carried out and finally the recooling takes place (so that the pressure which has built up is reduced again). However, for this process the produced plastic containers should be pressure-resistant (such as for example in the case of petaloid bases). In the above method the containers do not have to be pressure-resistant and can for example have normal still water bases or juice bottle bases. In these cases the negative pressure can be reduced after a certain time.

As mentioned above, for this purpose the container wall or the circumferential wall of the container closure is preferably pierced in order thus to be able to introduce the gaseous medium.

In a further preferred method the container wall is pierced in an upper half of the container and in particular an upper third of the container (or the opening is introduced at this point). In this case the term "the upper half" is relative to the longitudinal direction of the container which extends from a base of the container to the mouth of the container. Advantageously the container wall is pierced in an upper quarter, particularly preferably in an upper fifth relative to the longitudinal direction. Particularly preferably the piercing of the container wall takes place in a head or shoulder region of the container or in a region in the immediate proximity of a carrying ring of the container, for example below or above the said carrying ring. However, it would also be possible that the wall is pierced at a different location, for example the circumferential wall, for example when the containers are transported horizontally. An advantage of this method is that then the circumferential wall can be pierced, which as a rule is thinner than the wall in the region of the mouth of the container. For this purpose a container turner can be used. In this case it would be possible that the container is rotated and preferably in this way the container closure (with the hot product) is sterilised.

In this case it is possible that a second container turner is provided which rotates the container again into the starting position. However, it would also be conceivable that the same container turner is run through twice.

In this embodiment a device is produced in which the container comes to lie horizontally and can be pierced on the side wall (and in particular in a region in which no liquid is located in the horizontal position).

The opening is preferably made in a region of the container in which, in the case of an upright container, no liquid is present at the time of penetration. In this way the liquid can be prevented from escaping through the opening.

As mentioned above, the gaseous medium is preferably introduced into the head space of the container via this said opening. In this case the gaseous medium is introduced at a specific positive pressure in order preferably to achieve a residual pressure, that is to say final pressure, in the container which is at least equal to the ambient pressure, and which is preferably slightly above the ambient pressure. Advantageously, a residual pressure inside the container can be between 1.1 and 2.5 bar, preferably between 1.1 and 2.0 bar, preferably between 1.1 and 1.8 bar, preferably between 1.1 and 1.5 bar and particularly preferably between 1.1 and 1.3 bar. In this case these details relate to the absolute pressure.

The opening made in the container is preferably spaced apart from the mouth of the container and particularly preferably a thread of the container is located nearer to the mouth than the said opening.

In a further preferred method, the opening via which the gaseous medium has been fed to the container is closed or sealed again after the feeding of the gaseous medium. In this case this closing or sealing of the opening can take place in a different way. The term "sealing" is used hereafter. This sealing is advantageously carried out by means of a method which is selected from a group of methods which includes melting of a portion of the container wall, melting of a portion of a circumferential wall of the container closure, or a relative rotation of the container closure relative to the container.

Thus it would also be possible that the needle which pierces the container wall is hot and subsequently closes the pierced region again. In addition, however, a discrete welding head could be provided which, after the retraction of the needle, is pressed onto the hole in order to close the opening again.

It would also be conceivable that an "external melting point" is applied which preferably consists of a material which differs from the material of the container wall.

In this case this sealing is possible during or after sealing of the container with the container closure.

In the last variant the container closure is initially not yet completely screwed on the container mouth, so that gas can still enter. Only after the feeding of this gas the container closure is completely screwed onto the container. In this variant the advantage is produced that the gas feed can also still be carried out during a closure process. Particularly preferably, however, closing or sealing of the opening takes place by processes such as melting or welding of the container wall.

It would also be conceivable that the closure is "opened" again after the recooling (preferably, however, without in this case tearing a tamper-evident band). Thus the pressure equalisation can take place without the need for penetration, whilst the negative pressure has already been built up. Thus again it is advantageous that it is not necessary to use a container (in particular base) which is resistant to positive pressure.

Both the production of the opening and also the sealing of the opening preferably take place under clean room conditions and/or inside a clean room. These processes advantageously take place during a movement of the containers and in particular during transport of the containers in their transport direction. In addition to or instead of the clean room a chamber can also be provided which in particular surrounds the opening in the container wall and by means of which the gaseous medium is introduced into the container. In this case this chamber does not necessarily have to accommodate the entire container.

When such a chamber is used, on the one hand the "clean room" (which is formed by this chamber) can be reduced in size and on the other hand it can also be placed under a positive pressure, so that there is no need for a discrete gas feed device into the container, but the gas "automatically" enters the container after the penetration or partial opening.

In a further preferred method, closing or sealing of the container (or of the opening) is checked by means of an inspection device. Thus for example an in particular visual inspection can be carried out to ascertain whether the said opening has been closed. This inspection preferably takes place contactlessly and particularly preferably visually.

In a further preferred method, the gaseous medium is fed to the container in such a way that after the feeding of the gaseous medium a pressure which is above the ambient pressure prevails inside the container. Therefore a slight positive pressure advantageously exists in the container which is now closed. However, this positive pressure can still be lowered by further cooling processes.

However, it would also be possible to set the pressure to the atmospheric pressure. This can then be sufficient above all when the container is sufficiently recooled beforehand. The opening of the container leads to the reduction of the negative pressure, and the "ambient" or atmospheric pressure prevails. The "atmospheric pressure" is sufficient if it is ensured that negative pressure is not produced again by further recooling.

However, a slight positive pressure (above atmospheric) can also be present. This is of interest in particular if the treatment described here takes place with a container which is not yet completely recooled. Due to the slight positive pressure there is then sufficient "pressure reserve" in order not to fall below ambient pressure during further recooling of the container, that is to say to establish a negative pressure in the container.

In this case in a variant the method can be envisaged so that during the treatment with the gas the container is introduced into a chamber with defined environmental conditions, for example filled with inert gas under specific pressure conditions. If a hole is now introduced into the container, the gas located in the chamber flows into the container, without it being necessary in this case for gas to be "pumped" into the container by means of a discrete device.

This method can be conceived in particular so that the closure in the (overpressure) chamber is slightly opened (albeit only to such an extent that the tamper-evident strip does not tear off) and the negative pressure in the bottle is reduced by means of the thread. This variant has the advantage that the container does not have to be processed invasively.

Furthermore, the present invention is directed to a method for producing liquid containers and in particular beverage containers. In a first method step a plastic container is at least partially transformed by means of being acted upon by a liquid medium. Then the plastic container is filled with a preferably heated liquid, and in particular with the liquid used for the transforming. In a further method step at least partial closing of the container, which is filled with the liquid, is carried out with a container closure.

According to the invention, after the at least partial closing of the container a temperature regulation and in particular cooling of the container and/or of the liquid located in the container takes place and preferably a gaseous medium is fed into the interior of the container, in particular the head space of the container, via at least one opening introduced into at least one portion of a wall of the plastic container or a circumferential wall of the container closure or via an intermediate space which exists between a mouth and the container closure. In other words it is proposed that, following a (hot) hydraulic container shaping, a subsequent pressure equalisation in the container takes place by a gas feed from the exterior. In this case the method can be provided with all features described in connection with the above method individually or in combination and vice versa.

Thus, in other words, an at least partial hydraulic deformation of the container, which is hereby and/or subsequently filled with hot liquid which is preferably the liquid from the deformation process is proposed. In a (subsequent) further process step the container is closed. Preferably in a (subsequent) further method step the product is cooled, and preferably subsequently, but conceivably also already during the cooling step, gas is introduced into the head space of the container.

In this case an at least partial transformation is understood in particular as a permanent transformation (at ambient temperature) of at least one region of the container.

It is also conceivable that only specific (predetermined) deformation steps or transforming steps or shaping steps are carried out or take place hydraulically or by means of a liquid and at least one specific (or predetermined) deformation step or transforming step or shaping step, for example the preliminary blow moulding of a plastic container or plastic parison, by means of a gaseous medium, for example with compressed air. A transformation of a plastic container, in particular of a plastic parison to produce a plastic container, preferably takes place both by means of application of liquid medium or liquid and also by being acted upon by gaseous medium.

In an advantageous embodiment, for (at least partial) transformation or shaping of the container the liquid which is used remains (later) in the container as end product. Preferably the liquid used for (at least partial) transformation or shaping of the container is not drained off or removed again from the container. It is also conceivable that after the shaping of the container the same liquid is fed further, preferably until a predetermined filling level and/or a predetermined filling volume is reached.

In a further advantageous embodiment the liquid used for (at least partial) transformation is a heated or warm and/or hot liquid. According to the applicant's knowledge this offers the advantage of a better process stability. The temperature of this liquid is preferably in a range between 45° C. and 110° C., preferably between 50° C. and 95° C., particularly preferably between 60° C. and 90° C. and especially preferably between 70° C. and 88° C. Advantageously, the medium which later remains in the container is used for shaping. The container is preferably closed immediately after the shaping.

In an alternative embodiment, in at least one transforming step or shaping step or deformation step of the container (at least also) a liquid (as moulding liquid) is used which preferably does not correspond to the end product and preferably does not remain in the container. In this embodiment therefore in a further method step the moulding means or the moulding liquid or a liquid used for transformation is drained off or removed from the container.

In a further advantageous embodiment, preferably after the closing of the container, the container is rotated, preferably by a predetermined angle, and preferably in a further method step (at least) the container closure is disinfected or sterilised.

The regulation of the temperature of the liquid located in the container preferably involves a cooling of the liquid located in the container. This temperature regulation process or cooling process takes place indirectly by means of a temperature regulation or cooling of the container.

In a further advantageous embodiment the temperature regulation or cooling of the liquid located in the container takes place actively and/or passively. A passive cooling (off) can take place for example by the transport of the container for a specific time t or a predetermined time period in a transport path. A passive cooling off (by the ambient air) of the container is also conceivable by the container remaining for the duration of a predetermined time period in a region with ambient air (cooler by comparison with the liquid temperature). In this case the temperature of the ambient air can have the conventional ambient temperature which is usual in this environment (without being specifically cooled down).

An active cooling can for example take place in a so-called recooler. This embodiment is advantageous because the cooling energy can be recovered more easily than in the case of passive cooling. Therefore, in a further method step at least a part of the released cooling energy is preferably recovered and is preferably consequently fed to the apparatus again. Moreover, this embodiment offers the advantage that (by comparison with passive cooling) the process time in the case of active cooling is considerably shortened.

Preferably, a cooling of the container and/or of the liquid located in the container does not (inevitably) take place up to ambient temperature. Thus, the applicant has found that a cooling of the container and/or of the liquid located in the container to (a maximum of) 40° C., preferably to a temperature in the range between 30° C. and 38° C., can be quite sufficient.

In this case the feeding of a gaseous medium into the interior of the container can take place by performing a penetration of the container, introduction of the gaseous medium and subsequent reclosure of the penetration site and/or by deformation of at least one region of the container (or specific/predetermined regions of the container) and introduction of the gaseous medium.

In an advantageous embodiment for feeding the gaseous medium into the interior of the container a deformation of at least one region of the container is carried out. In this case it is conceivable that at least in the region of the closure the already closed container is placed into a sealed chamber or is fed to a sealed chamber. In this case the chamber can contain the entire container or also only a part or portion thereof. Then a positive pressure is preferably established in the chamber, preferably in such a way that the container deforms in the region of the bottle mouth, so that a communication connection is produced from the chamber via the thread region of the container into the interior of the container. Preferably it may be necessary to open the closure of the container slightly, preferably without in this case destroying or damaging a tamper-evident strip of the closure, and preferably subsequently to introduce the gaseous medium into the interior, in particular the head space, of the container and then to close the container again.

In an alternative embodiment for feeding the gaseous medium, a penetration of the container is performed or the container is provided with an opening. The gaseous medium is preferably introduced through the penetration site or the opening into the interior of the container, in particular into the free space. In this case the opening or penetration site can be introduced both into the closure and also into the container. If the penetration site or the opening is introduced into the container, it is conceivable for the penetration site or the opening to be in the region of the mouth of the container and/or in the region of the side wall (preferably in the labelling region) and/or in the region of the bottom wall. After feeding of the gaseous medium an (active) sealing of the penetration site or of the opening preferably takes place. In this case closing can take place by the use of an external closure element such as for example a closing plug and/or by welding of the penetration site or of the opening.

In this case welding of at least one penetration site or opening provided for feeding gaseous medium and preferably all penetration sites or openings for (once only) feeding of gaseous medium can take place individually or in combination with one or more previously or subsequently described features with regard to welding of a penetration site.

Furthermore, the present invention is directed to an apparatus for producing containers filled with a liquid. This apparatus includes a transforming device which transforms plastic parisons into plastic containers. Furthermore, the apparatus has a filling device which is arranged downstream of the transforming device in a transport direction of the plastic containers, and which fills the plastic containers with a liquid and in particular a beverage. In this case this filling device is preferably suitable and intended for filling the container with a heated liquid. Furthermore, a closing device is also provided which closes the liquid-filled plastic containers at least partially with container closures.

According to the invention the apparatus has a gas feed device which feeds a gaseous medium to the containers during or after the closing process, preferably after a recooling process, wherein the gas feed device is suitable and intended for feeding the gaseous medium to the containers through an opening which is formed in a container wall, a circumferential wall of the container closure and/or an intermediate space between a mouth of the container and the container closure.

In a further advantageous embodiment the apparatus has a transport device which transports the plastic containers along a predetermined transport path. In this case it is possible that this transport device has grippers arranged on a rotatable carrier which move the containers correspondingly along a circular transport path. Advantageously, the transforming device and/or the closing device and/or the filling device is also designed as a transport device, so that the containers are transported during the transforming process and/or during the filling process and/or during the closing process.

In a further advantageous embodiment the apparatus has a cooling device which is arranged in the transport direction after the filling device and which cools the containers. In this case this cooling of the containers can take place for example by application of water thereto.

In a further advantageous embodiment the apparatus has a penetration device which is suitable and intended for piercing a least one portion of the wall of the container and/or at least one portion of the circumferential wall of the container closure. The opening via which the said gaseous medium is fed to the container or the interior of the container is preferably produced by this piercing.

However, it would also be possible that the closing device is designed in such a way that it applies the closure to the container in two steps, for instance it initially ensures with only a few turns that the closure holds onto the container, in order only later to screw the closure in a sealing manner onto the container. Alternatively, it would also be possible that an apparatus is provided which, after the sealing of the container, again carries out a slight opening thereof, for example by turning of the closure relative to the container, in order to be able to introduce the gaseous medium.

In a further advantageous embodiment the apparatus has at least one sealing device which is suitable and intended for closing or sealing the opening through which the gaseous medium has been fed to the container. As mentioned above, this closing device is for example a melting device which again melts the portion of the container in which the opening has been made. However, it would also be possible that the closing device is the device which attaches the container closure to the container. Thus, first of all for example the bottle closer could screw a closure only partially onto the container or not yet close it completely. This closing process could only be completed in a subsequent step. In general, this operation could be carried out in the same closer which closes the containers with closures or also in a discrete apparatus.

In a further advantageous embodiment the apparatus has a clean room, inside which the containers are transported at least at times. In this case this clean room can surround at least the region inside which the gaseous medium is fed. In this case it is possible that the clean room is formed by an upright housing, but it would also be possible that the clean room merely surrounds the transport path of the containers in the manner of a channel. It would also be possible that the transforming device also already transforms the plastic parisons into plastic bottles inside a clean room. In addition it would also be possible that at least one chamber is provided, within which the gaseous medium is fed to the containers. This chamber could be configured for example as a hollow cylinder in which the containers are located.

In a further advantageous embodiment the penetration device and/or the gas feed device is integrated into a region of the closer device which provides the containers with closures. Thus, this penetration device could for example be integrated into a gripping or holding device which holds the containers during the filling process. This gripping device could have a holding element which prevent a rotation of the plastic bottle with respect to its longitudinal direction. This element could be configured for example as a so-called spike plate which absorbs the closer torque.

This absorbing plate, which in the present state of the art has a very thin configuration, could within the context of the present invention be significantly thicker and could for example have a width of 3 to 5 cm. In this way it is possible that a penetration tool is integrated into this plate. This penetration tool can be for example a needle which is suitable and intended for piercing the container wall. Further elements, such as for instance the closing element or sealing element, which closes the pierced opening again, or also a pressure feeding device, can be integrated into this spike plate.

In addition, it would also be conceivable that the closing device is subject to predetermined conditions, such as in particular but not exclusively a specific positive pressure. In this case it is possible that, after the piercing, a part of the gas located in the environment flows into the container. In this case a discrete delivery of the gas could be dispensed with, since this takes place "automatically" due to the pressure equalisation tendencies.

In a further advantageous embodiment the apparatus has a pressure control device and/or a pressure regulation device which is suitable and intended for controlling and/or regulating the pressure by means of which the gaseous medium is introduced into the containers. Thus, for example a sensor device could be provided, which is suitable and intended for determining the respective pressure of the gas inside the container and/or the pressure with which the gas is fed to the container. Thus, in terms of apparatus a control and/or regulating device is provided, which controls and/or regulates the pressure by means of which the gas is fed to the container and/or the pressure under which the gas is then located in the container.

It is pointed out that this pressure regulation device can be used in all methods and machines described here, that is to say also in variants in which no penetration of the containers takes place in the closing device or which operate without penetration.

In addition, the elements described here such as the needle device and/or the closure element for closing the container wall could also be arranged in another region, such as for example relative to the said spike plate or relative to a gripping device which in particular grips a neck of the containers. Thus, it would also be possible that the penetration takes place radially from the exterior in the direction of the centre of the container, in particular in a region of the container mouth. This can preferably take place (locally) relative to a neck handling gripper. In this way it is possible that a tool is advanced from the exterior towards the container located in the gripping device or the closer and in particular towards the neck region of the container. This tool can for example abut the container and/or the carrying ring thereof, wherein both an active or passive gripping and also a simple abutment is possible here.

The respective process, that is to say the piercing, the introduction of the gas, the closing and/or the welding can take place as described above. The advantage of an arrangement of the said units, for example the piercing device, in the closer, leads to a saving of time in the overall process, since the closing process must be carried out in any case. The duration of the process of introduction of the gas approximately matches the duration of the closing process, so that these processes can also be combined well.

A pitch circle of the closer is preferably selected which is enlarged by comparison with the prior art, in order thus to be able to carry out both operations, that is to say the closing of the containers with the container closures and the feeding of the gas into the container, substantially concurrently. However, in this way it is possible to dispense with a further machine which serves for piercing the container wall.

However, it is pointed out that the idea described here of piercing in a region of the gripper is not limited to the closer. It is also possible that this piercing is carried out in a later treatment step, for example in the discrete unit downstream of the closer or in a transport path which is located between the closer and a further device, such as for instance a cooling assembly. It is also possible that this process of piercing is only carried out downstream of a recooling device. In particular, if the process of piercing only takes place downstream of a recooler, an integration or arrangement in a "normal" neck handling path is advantageous. In this case the container does not require a base which is resistant to positive pressure, so that the container itself can have a simpler and lighter configuration. In this case more design variants are available and also a high saving of material can be achieved.

One advantage of the closing of the pierced container is the use of a uniform "welding material". If during welding of a closure in some circumstances the correct colour is required when applying an "external spot weld", in the case of PET bottles transparent PET can be used as a rule. Furthermore, if no additional material is required during this closure or sealing, there is no need for the advantage mentioned here.

Furthermore, it is also possible that the said penetration of the container wall is carried out by optical means, for example by means of a laser. Thus, for example a hole can be welded into the container wall by means of a laser. The advantage of this procedure is that it is possible to dispense with mechanical elements, such as the above-mentioned needles. The sealing of the opening could possibly also be carried out by means of a laser. In particular in this variant the feeding of the gaseous medium can take place by means of the above-mentioned chamber. Thus, it is possible that inside this chamber the hole is welded in by means of a laser and then the correct pressure is set. This procedure has the advantage of a high level of hygiene, since no mechanical components engage on the container.

Furthermore, it is also possible that the piercing means, such as for instance a needle, also serves for feeding the gas, for instance if this needle is configured as a hollow needle. As mentioned above, feeding of the gas into the container via a side wall of the closure is also conceivable. In this procedure the closure is preferably not pierced from above but via the circumferential wall thereof. In this way it is possible that the gas advances between the thread turns into the interior of the container. It is also possible that this hole is closed again after the penetration. In order to prevent escape of the gas to be fed, it is possible to begin the closing process, that is to say the closing process by means of which the closure is attached to the mouth, and to complete it by one to two turns of the closure in the thread. As a result, on the one hand the space between the closure and the container is closed off from the environment (since the thread already grips), but the sealing effect between the closure and the container is not yet produced. After the introduction of gas the closing process is terminated. It is also conceivable here that the tool is formed in the container gripper or as a discrete tool. As also already described previously, the hole can then be closed again.

Furthermore, it would also be conceivable that a hole which is no longer closed is provided or also introduced in the closure. This may be possible in so far as the hole is placed in such a way that, with a closure half screwed on, it provides an access to the interior of the bottle, whilst with the closure fully screwed on access is no longer possible. This can be achieved for example in such a way that the hole in the thread turn has moved so far in the direction of the carrying ring that a connection is precluded. However, the effect of the lack of access from the hole into the interior of the container can also be based on the fact that in the closed container the sealing between the closure and the container (for example on the mouth) is already produced. In such closures a position of a pierced hole can be chosen substantially freely.

Furthermore, a procedure would also be conceivable in which the closure already has several holes in its side wall. This can be advantageous on the one hand in terms of design. The end customer then has not the impression that the hole has been added subsequently and the product has been damaged thereby. A technical effect is that several gas paths are available and thus the introduction of gas into the head space can be substantially accelerated, which has a positive effect on the processing time. Here too it is conceivable that initially the closure is screwed on only a little or by a few turns (depending upon the thread turn) and then the tool or the tools are placed on and in the holes, in order to guide the gas into the interior of the container. After the gas is located there, the process of closing the container closure can be continued and ended.

Furthermore, it would also be conceivable that the gas is introduced via the thread turns into the interior of the container without the closure being provided with holes. For this purpose a closure can be screwed a little way onto the neck of the container in order to achieve initial holding of the closure. However, a sealing action is not yet carried out between the closure and the container. In this phase a sealing head is preferably provided which is placed over the closure. In this case this sealing head has a gas feed device, so that this gas—sealed off from the environment—can then enter the interior of the container via the thread turns. This sealing head is preferably configured in such a way that it completely surrounds the mouth of the container. It is also possible that the sealing head has sealing means which can achieve a sealing relative to the wall of the container. Thus, for instance a circumferential sealing lip could be provided which can be applied to a shoulder region of the container. The use of a sealing head is also suitable in a particular manner in connection with a chamber, inside which the container is filled with the gaseous medium.

In a further advantageous embodiment a screw closure head can also be formed in such a way that it provides the sealing effect relative to the environment and also has the gas feed. In this way only one tool is required in order to carry out the closing process and the air supply. In this case it would also be conceivable in particular that a closing process is already started, so that the closure does not lift off due to feeding of the gas. However it would also be possible that the apparatus has a holding-down element for the closure, so that in this case the closing process does not yet have to be started when the feeding of the gas begins.

As mentioned above, it is also conceivable to carry out the introduction of gas into the container only downstream of a recooler. For this purpose a space sealed off from the environment can likewise be available which in particular is arranged around the closure, or a chamber can be available which accommodates the entire container. A gas can then be introduced with positive pressure into this space, preferably in such a way that the gas can enter the interior of the container between the thread turns. In this case it is possible that the closure lifts off slightly, so that advantageously a sealing effect between the closure and the container is overridden, in order to allow the gas to enter there.

Furthermore, it is also conceivable that piercing of the wall of the container takes place in principle in the side wall or in the base. In this case it is conceivable and preferable that the container is rotated, and for example is brought into a horizontal position, so that the piercing can take place in the side wall. With a piercing in the side wall a penetration in the region of the later labelling region is particularly advantageous, since any visual detriment can already be concealed by a label. A penetration in the base region of the container is also conceivable, for example in the injection point. In this region the container is substantially unstretched and thus amorphous. This applies in particular in the case of a production process for stretch blow moulded containers, such as PET containers. In addition, a relatively large amount of material is available in the region of the injection point, in order then to melt the opening again.

Here too a needle or something similar can be used for piercing again. Welding can take place for example by a discrete welding punch or also by the needle itself, wherein in this case the needle is then advantageously hot.

Furthermore, the present invention is directed to an apparatus for processing plastic containers closed by container closures and in particular for carrying out a pressure equalisation in such containers. This apparatus has a penetration device which is suitable and intended for introducing an opening into a wall of the container or into a circumferential wall of the container closure, and a gas feed device which is suitable and intended for feeding the gaseous medium through this opening to the containers.

The apparatus preferably has a sealing device which is suitable for closing the opening through which the gaseous medium has been fed to the container. In a further advantageous embodiment the apparatus has a moving device in order to advance the penetration device towards the container.

In a further preferred embodiment the sealing device has a melting device which is suitable and intended for locally melting the material of the plastic container. In a further advantageous embodiment the apparatus has a holding device which is suitable and intended for holding the containers. This is in particular a gripping device which grips the plastic container in a predetermined portion thereof.

In a further preferred embodiment the machine has a transport device which is suitable and intended for transporting the container. This transport device preferably has a carrier which is rotatable about a predetermined axis of rotation.

The gas feed device preferably has a chamber into which the plastic container can be introduced.

Furthermore, the present invention is directed to an apparatus for producing liquid containers and in particular beverage containers. In this case this apparatus is suitable and intended for at least partially transforming a plastic container by means of application of a liquid medium (by an application device). Furthermore, the apparatus is suitable and intended for filling the plastic container with a, preferably heated, liquid, in particular the liquid used for the transformation, and (subsequently) at least partially closing the liquid-filled container with a container closure.

According to the invention the apparatus is suitable and intended, after the at least partial closing of the container, to regulate the temperature of the container and/or the liquid located in the container, in particular to cool the container and/or the liquid located in the container (by a cooling device), and to feed a gaseous medium into the interior of the container, in particular the head space of the container, preferably via at least one opening introduced into at least one portion of a wall of the plastic container or a circumferential wall of the container closure or via an intermediate space which exists between a mouth and the container closure. In this case the apparatus is preferably suitable and intended for carrying out the method proposed above. Additionally, the apparatus can be provided with all features described in connection with the apparatus and methods set out above, individually or in combination, and vice versa.

BRIEF DESCRIPTION OF THE DRAWINGS

Further advantages and embodiments are apparent from the appended drawings.

In the drawings.

DETAILED DESCRIPTION OF THE INVENTION

Figure 1A:
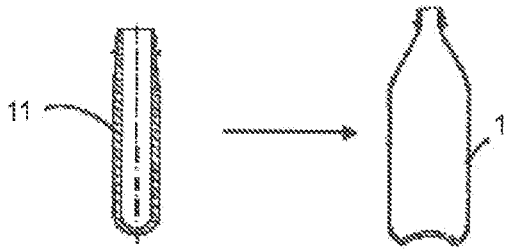
FIGS. 1*a* to 1*c* show a schematic sequence of a method according to the invention.
Figure 1B:
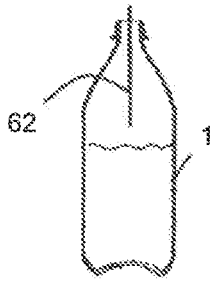
Figure 1C:
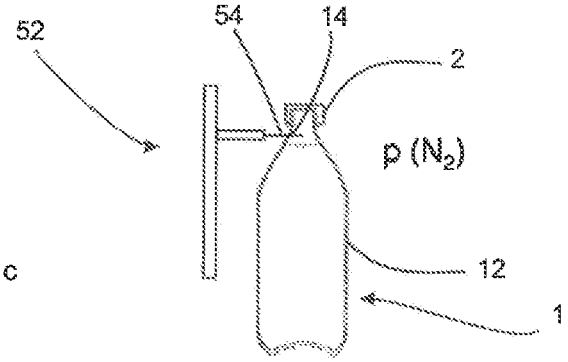

FIGS. 1*a* to 1*c* show a schematic representation of a method according to the invention. As shown in FIG. 1*a*, first of all a plastic parison 11 is blow moulded to form a plastic container 1. This takes place particularly preferably by means of a blow moulding machine. In this case this blow moulding machine can preferably have a moving and in particular rotatable carrier, on which a plurality of transforming stations are arranged for transforming plastic parisons into plastic containers and in particular plastic bottles. FIG. 1*b* shows a representation of a filling process. In this case a filling device such as a filling channel 62 is provided which introduces liquid into the container 1.

FIG. 1*c* shows schematically a piercing operation. Here the container 1 is pierced by means of a penetration tool 54, such as a needle, in the region of the mouth thereof. The reference 14 relates to the opening produced by this piercing operation which is configured in particular as a small hole. The reference 12 designates the wall of the container 1. The reference numeral 2 designates a container closure which is already attached to the container 1. Thus the opening 14 produced by the penetration device 54 preferably constitutes the single opening of the container 1, since the mouth of the container 1 is already closed by the container closure 2. At this stage a gas, such as for example nitrogen, can now be fed to the container 1. In this case this feed can take place by means of the penetration tool 54 or by means of a further channel 52 which feeds the gas to the container by means of the opening 14 introduced by the penetration tool 54. It is also possible that a wall region 12 in which the said opening 14 is located is sealed relative to the environment by means of a sealant and so a space surrounding the opening is produced, to which the gaseous medium is then fed under pressure, so that said medium flows from this space through the opening 14 into the interior of the container 1.

Figure 2A:
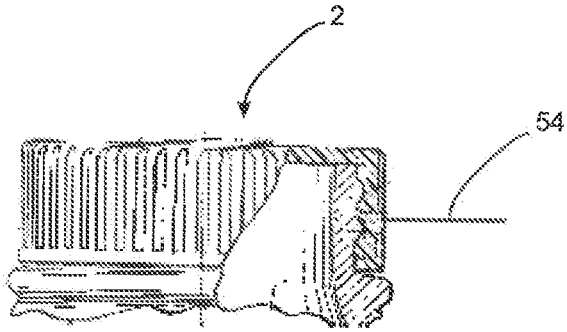
FIGS. 2*a* to 2*c* show three representations for illustration of a gas feed through a container closure.
Figure 2B:
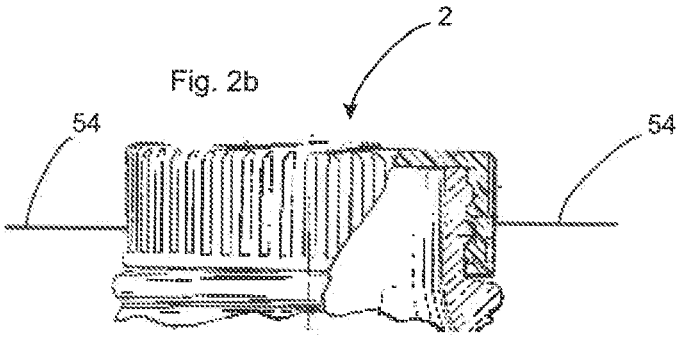
Figure 2C:
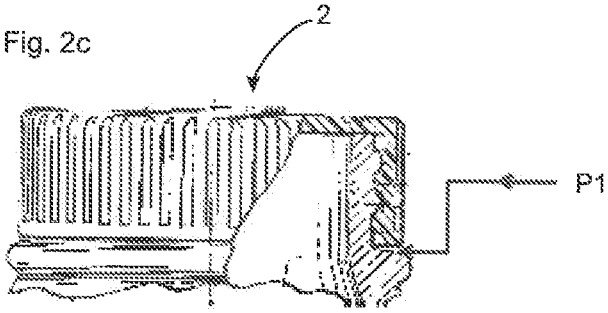

FIGS. 2*a* to 2*c* illustrate three procedures for introduction of the gaseous medium by means of the container closure 2. In the variant proposed in FIG. 2*a* the closure 2 is pierced on its circumferential wall or laterally by the penetration tool 54. The subsequently introduced gas can enter the interior of the container by means of the thread turn of the container. This is conceivable in particular when the closure 2 is not yet completely screwed onto the mouth of the container, in contrast to what is shown in FIG. 2*a*. However, it would also be conceivable that the penetration tool 54 pierces through both the closure 2 and also the mouth of the container lying below it.

In the variant illustrated in FIG. 2*b* several openings are located on the external circumference of the container closure 2. In this way the container closure 2 can be pierced for example at opposing points.

In the variant configured in FIG. 2*c*, as shown by the arrow P1, the gas is fed between a container closure 2 and a carrying ring of the container and subsequently fully reaches the actual mouth of the container by means of the said thread turn. In this configuration it is also preferable during the feeding of the gas that the closure 2 is not yet completely screwed onto the mouth.

Figure 3:
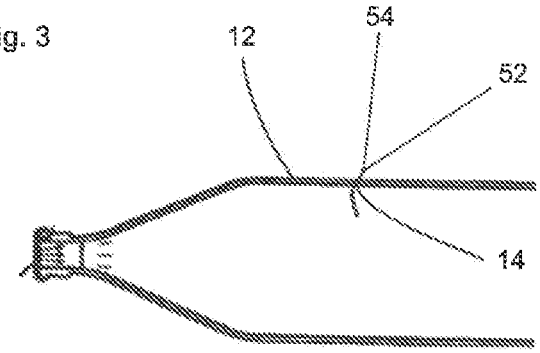
FIG. 3 shows a representation for introduction of a hole into a wall of the container.

FIG. 3 shows a further embodiment in which the penetration tool 54 is introduced into a lateral wall of the container 12. In order to carry this out, the container is preferably transported horizontally.

Figure 4:
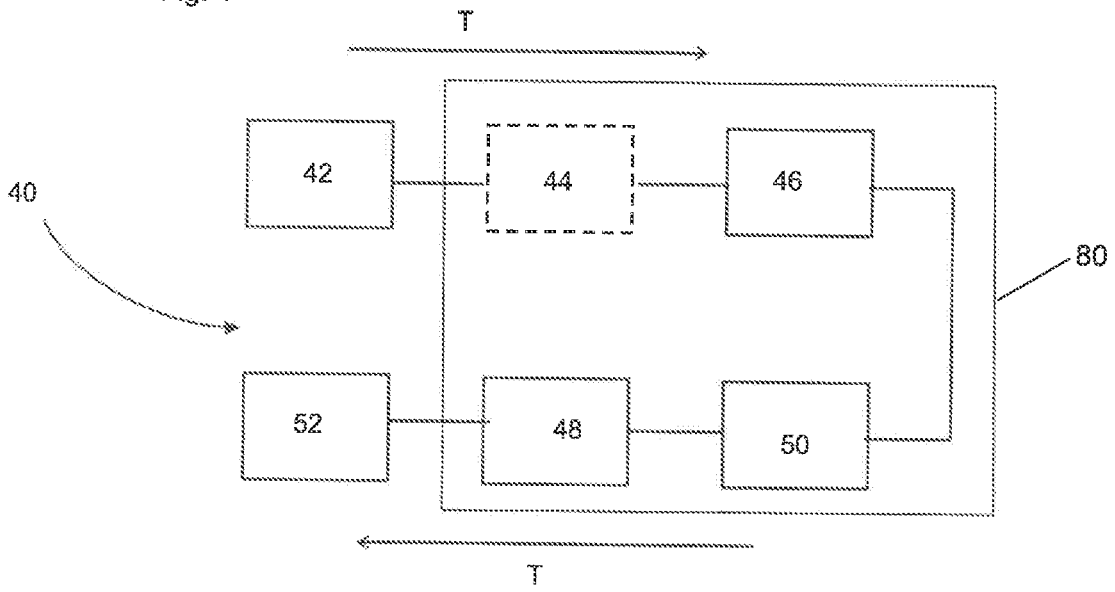
FIG. 4 shows a roughly schematic representation of an apparatus according to the invention.

FIG. 4 shows a schematic representation of a machine 40 according to the invention. In this case first of all a transforming device 42 is provided, which is suitable and intended for transforming plastic parisons into plastic containers. This transforming device can have a heating device, such as for example an oven, which is connected upstream of the actual transforming device and serves to heat the plastic parisons sufficiently so that they can be blow moulded to form containers.

The reference numeral 44 designates an optionally provided sterilising device, which sterilises the plastic bottles produced by the transforming device 42. The reference numeral 46 designates a filling device which introduces a gas into the produced container.

The reference numeral 50 designates a closing device which closes the plastic container. The reference numeral 52 designates a gas feed device which is suitable and intended for introducing the gas into the container by means of the above-mentioned opening.

In this case this gas feed device 52 can simultaneously also have the penetration tool described above.

The reference numeral 48 designates a cooling device which is suitable and intended for cooling the hot filled containers. As mentioned above, this gas feed device 52 can also be arranged at other positions of the entire apparatus, for instance also already in the region of the closing device 50, or at other positions, in particular upstream of the recooling device 48. As illustrated in FIG. 4, the sterilizing device 44, the filling device 46, the cooling device 48 and the closing device 50, are located within a clean room 80.

Figure 5:
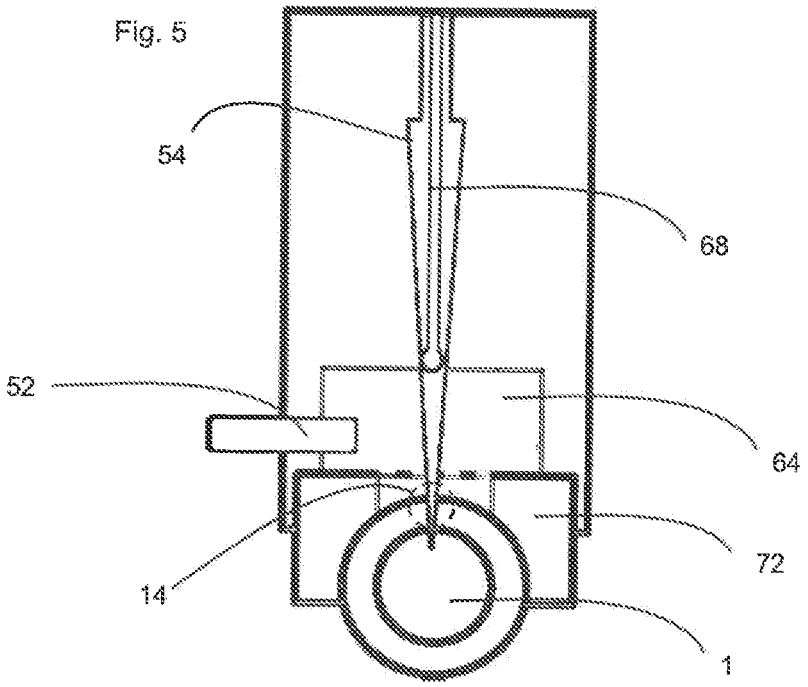
FIG. 5 shows a view of a detail of a piercing and gas feeding device.

Finally, FIG. 5 shows a representation of a possible procedure for feeding gas into the container. In this case first of all the penetration device 54 is again provided in the form of a needle which pierces the wall of the plastic container 1. The reference numeral 52 designates the actual gas feed device, which introduces a gaseous medium into the container 1 via the hole produced by the penetration device 54. The reference numeral 64 designates the chamber which serves for supply of the gas by means of the supply conduit 52. In this case this chamber can be intermittently sealed relative to the container 1 in order thus to be able to introduce the gaseous medium under a slight positive pressure into the container 1. The gas which should ultimately enter the container can be fed to this chamber via the opening 14. In this case this gas is preferably fed at a positive pressure to the chamber 64, so that it flows into the container 1 due to the pressure conditions. The reference numeral 72 designates a corresponding sealing device by means of which the chamber 64 can be sealed relative to the environment. In this case this sealing device 72 can also serve simultaneously as a gripping element for the container 1.

The reference numeral 68 designates a closing or sealing device which closes the hole produced by the penetration device 54, for example by a melting process.

In the embodiment illustrated in FIG. 5 the two tools, that is to say the penetration device 54 and the sealing device 68, are arranged one above the other. It would also be conceivable that these tools are arranged adjacent to one another or also obliquely with respect to one another. However, in the mentioned cases the tools should be arranged movably only in such a way that it is ensured that precisely the location which has been pierced is closed/welded. In this view from above, as also already shown in FIGS. 1*c* and 3, the opening 14 is again evident.

The applicant reserves the right to claim all the features disclosed in the application documents as essential to the invention in so far as they are individually or in combination novel over the prior art. Furthermore it is pointed out that in the individual drawings features were also described which may be advantageous per se. The person skilled in the art recognises immediately that a specific feature described in a drawing may also be advantageous without the incorporation of further features from this drawing. Furthermore the person skilled in the art recognises that advantages may also result from a combination of several features shown in individual drawings or in different drawings.

LIST OF REFERENCES

1 plastic container
2 container closure
11 plastic parison
12 wall of the container
14 opening
40 apparatus
42 transforming device
44 sterilising device
46 filling device
48 cooling device
50 closing device
52 gas feed device/feed conduit
54 penetration tool/penetration device
62 filling channel
64 chamber
68 closing or sealing device
72 sealing device
80 clean room
P1 arrow

The invention claimed is:

1. A method for producing liquid containers and in particular beverage containers, comprising the steps of:

producing a plastic container by a blow moulding process;

filling the plastic container with a flowable medium;

at least partially closing the container, which is filled with the liquid, with a container closure;

wherein, after the at least partial closing of the container, a gaseous medium is fed to the interior of the container via at least one opening introduced into at least one portion of a wall of the plastic container or a circumferential wall of the container closure, wherein the opening via which the gaseous medium is fed to the container is closed after the feeding of the gaseous medium, and wherein the closing of the at least one opening is carried out by a relative rotation of the container closure relative to the container.

2. The method according to claim 1, wherein after the production of the container the opening is introduced into the portion of the wall of the container and/or the wall of the container is pierced in an upper half of the container.

3. The method according to claim 1, wherein the plastic container is filled with a heated liquid.

4. The method according to claim 1, wherein the liquid-filled plastic container is cooled.

5. The method according to claim 1, characterised in that a closing of the container is checked by an inspection device.

6. The method according to claim 1, wherein the gaseous medium is fed to the container in such a way that after the feeding of the gaseous medium a pressure which is above the ambient pressure prevails inside the container.

7. An apparatus for producing containers filled with a liquid comprising a transforming device, which transforms plastic parisons into plastic containers, a filling device which is arranged downstream of the transforming device in a transport direction of the plastic containers and which fills the plastic containers with the liquid, and a closing device which closes the liquid-filled plastic containers at least partially with container closures, wherein the apparatus has a gas feed device which feeds a gaseous medium to the containers during or after the closing process, wherein the gas feed device is configured for feeding the gaseous medium to the containers through an opening which is formed in a container wall or a circumferential wall of the container closure, wherein a further closing device is configured for closing the opening by a relative rotation of the container closure relative to the container.

8. The apparatus according to claim 7, wherein the apparatus has a cooling device which is arranged downstream of the filling device in the transport direction and which cools the containers filled with the liquid.

9. The apparatus according to claim 7, wherein the apparatus has a penetration device which is suitable and intended for piercing at least one portion of the wall of the container or at least one portion of the circumferential wall of the container closure.

10. The apparatus according to claim 7, wherein the apparatus has at least one sealing device which is configured for closing the opening through which the gaseous medium has been fed to the container.

11. The apparatus according to claim 7, wherein the apparatus has a clean room, inside which the containers are at least at times transported.

* * * * *